United States Patent [19]

Premel et al.

[11] Patent Number: 4,457,361

[45] Date of Patent: Jul. 3, 1984

[54] CONNECTION ELEMENT FOR THE TRANSFER OF KNOCK- OR IMPACT-ENERGY UPON HEATING OR COOLING SURFACES TO BE CLEANED AND LOCATED IN A PRESSURE VESSEL

[75] Inventors: Ulrich Premel; Gustav Thönes, both of Gummersbach, Fed. Rep. of Germany

[73] Assignee: L. & C. Steinmüller GmbH, Gummersbach, Fed. Rep. of Germany

[21] Appl. No.: 397,849

[22] Filed: Jul. 13, 1982

[30] Foreign Application Priority Data

Jul. 14, 1981 [DE] Fed. Rep. of Germany ..... 3127734

[51] Int. Cl.[3] ..... F28D 11/06; F28G 7/00

[52] U.S. Cl. ..... 165/84; 165/95; 29/81 D

[58] Field of Search ..... 29/81 R, 81 C, 81 D; 134/102; 15/92, 94; 173/171, 80; 165/84, 80 A, 80 E

[56] References Cited

U.S. PATENT DOCUMENTS 3,571,874 3/1971 Von Arx ..... 29/81 D
3,997,000 12/1976 Piela ..... 165/84

FOREIGN PATENT DOCUMENTS 530567 12/1940 United Kingdom ..... 29/81 D
875198 10/1981 U.S.S.R. ..... 165/84

*Primary Examiner*—Carl E. Hall
*Assistant Examiner*—John Burtch
*Attorney, Agent, or Firm*—Becker & Becker, Inc.

[57] ABSTRACT

A method and apparatus including a connection element for transfer of knock- or impact-beating energy from a mechanically, hydraulically or pneumatically driven knock- or impact-beating device upon heating or cooling surfaces to be cleaned intermittently. The heating or cooling surfaces are installed in a container or vessel driven and operated on the gas side at an elevated pressure compared with respect to the atmospheric environmental pressure. The heating or cooling surfaces have external flow of hot, dust-laden gases thereagainst. The knock- or impact-beating device is fastened externally of the pressure container. In the region of the knock- or impact-beating energy transferring from the knock- or impact-beating device as far as to the heating or cooling surface to be cleaned there is applying of a counter gas pressure during energy transfer as to the higher container-gas pressure otherwise preventing or precluding the energy transfer; the container-gas pressure is countered with a gas pressure of equal magnitude which is communicating or non-communicating with respect thereto. A pressure equalizing or balancing connection element is inserted or connected between the mechanically, pneumatically or hydraulically operated and driven knock- or impact-beating device and the heating or cooling surface to be cleaned. This connection element collectively includes the housings, the energy transfer element and a shut-off or blocking element. A compensating or equalizing passage connecting both of the pressure chambers of the pressure container is provided with the energy transfer element and sealing elements are provided to separate the pressure chambers from each other and to seal against the housings.

7 Claims, 1 Drawing Figure

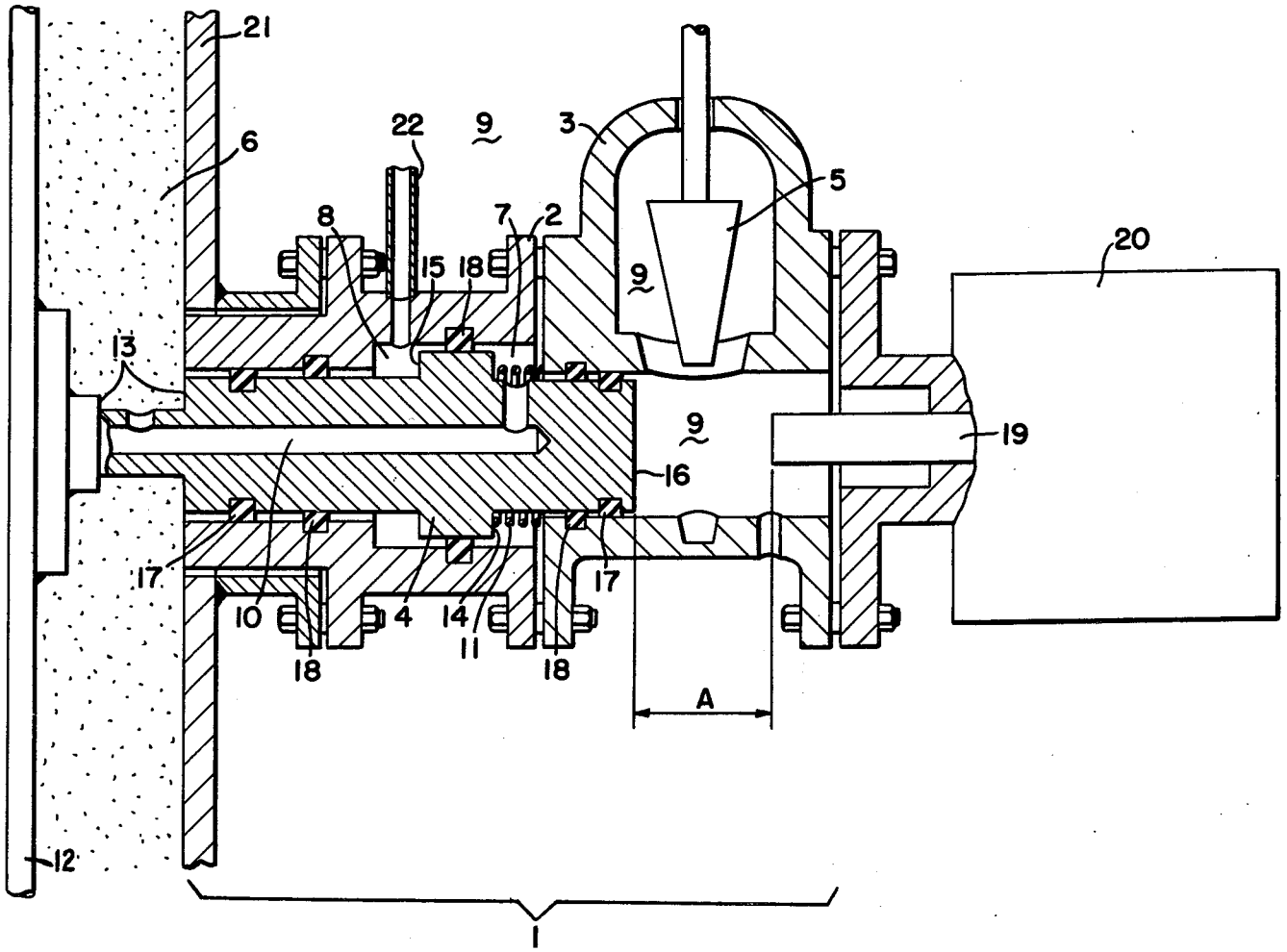
20
19
5
9
16
A
3
2
7
18
17
11
14
4
22
15
8
10
21
6
13
12
I

CONNECTION ELEMENT FOR THE TRANSFER OF KNOCK- OR IMPACT-ENERGY UPON HEATING OR COOLING SURFACES TO BE CLEANED AND LOCATED IN A PRESSURE VESSEL

The present invention relates to a method for transfer of knock- or impact-energy from a mechanically, hydraulically or pneumatically operated knock or impact device upon heating or cooling surfaces to be cleaned intermittently. The heating or cooling surface means are installed in a container operated on a gaseous side at a pressure elevated with respect to the atmospheric environmental pressure and having external flow of hot, dust-laden gases thereagainst. The knock or impact device is fastened externally of the pressure container. The present invention also relates to a connection element to carry out such method.

Methods and apparatus are adequately known for cleaning of hot or cooling surfaces upon which the knock- or impact-energy from a mechanically, hydraulically or pneumatically operated knock- or impact-device is transferred; the heating or cooling surface is accelerated thereby up to 100 meters per second squared ($m/s^2$) under pressureless and pressure equalized operating conditions on all sides.

The cleaning effect is hereby attained thereby that the heating surface and the deposits adhering thereto as a consequence of different or varying mass moment of inertia are accelerated variously through the transferred knock- or impact-energy whereby the deposits drop from the heating surface.

The transfer of the knock- or impact-energy occurs upon heating or cooling surfaces which are installed in containers operated on the gaseous side at an elevated pressure with respect to the atmospheric environmental pressure, as for example in coal-pressure vaporization systems or plants with a pressure of approximately 40 bar on the gaseous side; the knock- or impact-device is fastened externally of the pressure container; such transfer of knock- or impact-energy involves difficulties since a portion of the knock- or impact-energy must be employed for overcoming the container-gas-interior pressure, and accordingly the entire knock- or impact-energy is not available for cleaning of the heating or cooling surfaces.

An object of the present invention is to provide a method for transfer of knock- or impact-energy from a mechanically, hydraulically or pneumatically operated knock- or impact-device upon heating or cooling surfaces to be cleaned intermittently; the heating or cooling surfaces are installed in a container operated on the gaseous side at a pressure elevated with respect to the atmospheric environmental pressure and having external flow of hot, dust-laden gases thereagainst externally; the knock- or impact-device is fastened externally of the pressure container; and the object of the present invention is also to provide a connection element for carrying out or performing the method whereby the previously mentioned problem is avoided.

The object according to the present invention is fulfilled by proposing that, in the region of the knock-or impact-energy transfer from the knock- or impact-device to the heating or cooling surface to be cleaned during the energy transfer, there is a gas pressure acting counter to the higher, container-gas pressure otherwise preventing the energy transfer; according to the present invention, this higher, container-gas pressure is countered by an equally large, communicating or non-communicating gas pressure effective thereagainst.

In a further construction according to the present invention, there is proposed a connection element for carrying out the method, whereby a pressure balancing or equalizing connection element, connected between the mechanically, hydraulically or pneumatically operated knock- or impact-device and the heating or cooling surface to be cleaned, consists of the housings of the energy transfer element and the shut-off element; the energy transfer element, provided with a compensating or equalizing passage connecting both of the two pressure chambers, with sealing elements to separate the pressure chambers from each other and to seal against the housing and with equal, compressively loadable surfaces, is pressed by a spring against the heating or cooling surface and there is a distance or spacing A from the transfer piston of the knock-or impact- or beating device dependent upon the available, maximum knock- or beating/impact energy.

The present invention further proposes that the pressure chamber in the connection element, in place of the compensating or equalizing passage communicating with the pressure chamber and located in the energy transfer element, is connected with an externally driven gas pressure equalizing device; the pressure chamber via the connection line or conduit with the pressure chamber is connected either with an external collecting vessel, reservoir or storage tank or with the atmosphere. This object, and other objects and advantages of the present invention, will appear more clearly from the following specification in connection with the accompanying drawing, in which:

FIG. 1 shows a sample embodiment of a connection element to perform the method of the present invention.

Referring now to the drawing in detail, a connection element 1 is located between the mechanically, hydraulically or pneumatically operated knock- or impact-beating device 20 fastened externally of a pressure container and the heating or cooling surface 12 to be cleaned as installed within the pressure container 21; the connection element consists of the housings 2,3, the energy transfer element 4 and the shut-off element or blocking element 5. The energy transfer element 4 is provided with a compensating or equalizing passage 10 connecting both of the two pressure chambers 6,7 as well as being provided with sealing elements 17, 18 to separate the pressure chambers 6,7,8,9 from each other and to seal against the housings 2,3 and also being provided with equal, compressively loadable surfaces 13,14,15,16. The pressure chambers 6 and 7 or 8 and 9 are respectively in equilibrium or equal in pressure and have the gas pressure of the pressure container or that of the environment. The spring 11 presses the energy transfer element 4 against the heating and cooling surface 12 so that no energy loss occurs during the energy transfer. If deposits are to be cleaned from a heating or cooling surface 12, the mechanically, hydraulically or pneumatically driven knock- or impact-beating device 20 is actuated. The transfer piston 19 of the knock- or impact-beating device 20 at the same time speeds once or more in the direction of the energy transfer element of the connection element 1, and, after overcoming or surmounting the distance or space A, transfers the available, maximum knock- or impact-beating energy during striking or impacting upon the energy transfer element 4. The energy transfer element 4 and finally the heating or cooling surface to be cleaned are accelerated up to 100 m/s$^2$, whereby a reduction of the knock- or impact-beating energy is avoided through the pressure balance or equalization brought about in the pressure chamber 6,7 via the equalizing or compensating passage 10 because of the equal surfaces 13 and 14 loaded or burdened oppositely with pressure. A possible further energy loss through compression of the gaseous atmosphere located in the pressure chamber 8 is prevented, precluded or obviated thereby that the pressure chamber 8 is connected via the connection line or conduit 22 with the pressure chamber 9 or with an external collecting vessel, reservoir or storage tank or with the atmosphere under favorable environmental conditions.

According to another example of construction according to the present invention not illustrated in further detail, in place of the compensating or equalizing passage 10 communicating with the pressure chamber 6 located in the energy transfer element 4, there is noted that the pressure chamber 7 in the connection element 1 is connected with an externally driven or operated gas pressure equalization device. The shut-off or blocking element 5 in the housing 3 of the connection element 1 renders possible flanging-off of the knock- or impact-beating device 20 as provided for maintenance or servicing purposes.

In summary, the present invention relates to a method or procedure for transfer of knock- or impact-beating energy from a mechanically, hydraulically or pneumatically driven and operated knock- or impact-beating device onto heating or cooling surfaces to be cleaned intermittently; the heating or cooling surfaces are installed in a vessel or container operated on a gaseous side thereof at an elevated pressure with respect to the atmospheric environmental pressure; the heating or cooling surfaces have external flow of hot, dust-laden gases thereagainst; and, furthermore, the knock- or impact-beating device is fastened therewith externally of the pressure container. In the region of transferrring of the knock- or impact-beating energy from the knock- or impact-beating device, as far as to the heating or cooling surface to be cleaned during the transferring of the energy, there is a step of countering the higher container gas pressure, preventing or precluding the energy transferring with such countering thereof being undertaken by an equally great, communicating or non-communicating gas pressure.

The connection element for carrying out or performing the foregoing method structurally consists of a pressure balancing or equalizing connection element 1 inserted or connected between the mechanically, hydraulically or pneumatically driven and operated knock- or impact-beating device 20 and the heating or cooling surface 12 to be cleaned consists of the housings 2,3, the energy transfer element 4 and the shut-off or blocking element 5; the energy transfer element 4 is provided with a compensating or equalizing passage 10 connecting both of the two pressure chambers 6,7 as well as being provided with sealing elements 17, 18 to separate the pressure chambers 6,7,8,9, from each other to seal against the housings 2,3 and also being pressed with equally large compression loadable surfaces 13, 14, 15, 16 by a spring 11 against the heating and cooling surface 12; and additionally there is provided a distance or spacing A from the transfer piston 19 of the knock- or impact-beating device 20 dependent upon the available maximum knock- or impact-beating energy.

The foregoing connection element has the pressure chamber 7 alternatively connected with an externally driven or operated gas pressure equalizing or compensating device in place of the compensating or equalizing passage 10 located in the energy transfer element 4 and communicating with the pressure chamber 6.

The foregoing connection element also alternatively has the pressure chamber 8 connected with the pressure chamber 9 via the connection line or conduit 22 or connected with an external collecting vessel, reservoir or storage tank or connected with the atmosphere under favorable environmental conditions.

The present invention is, of course, in no way restricted to the specific disclosure of the specification and drawing, but also encompasses any modifications within the scope of the appended claims.

What we claim is:

1. An apparatus for transfer of knock- or impact-beating energy from a mechanically, hydraulically or pneumatically operated and driven knock- or impact-beating device onto heating or cooling surfaces to be cleaned intermittently, whereby the heating or cooling surfaces are installed in a container operated on a gaseous side thereof at a pressure elevated with respect to atmospheric environmental pressure, the surfaces having an external flow of hot, dust-laden gases thereagainst, and the knock- and impact-beating device including a transfer piston and being fastened externally of the pressure container, comprising:

a pressure-compensating and equalizing connection element connected between the mechanically, pneumatically or hydraulically driven and operated knock- or impact-beating device and the heating- or cooling surface to be cleaned, said connection element including housing means, an energy transfer element, and a shut-off element, said energy transfer element having a compensating and equalizing means connected with two pressure chambers therewith, sealing elements to separate the pressure chambers from each other and to seal against the housing means, and a spring means to press equal, pressure loadable surfaces therewith against the heating and cooling surface, and having a spaced distance from the transfer piston of the knock- or impact-beating device dependent upon available maximum knock- or impact-beating energy.

2. An apparatus according to claim 1, wherein said compensating and equalizing means comprises a passage in said energy-transfer element.

3. An apparatus according to claim 1 wherein an externally driven and operated gas pressure equalization device is connected with at least one pressure chamber.

4. An apparatus according to claim 2, including a connection line interconnecting the pressure chambers.

5. An apparatus according to claim 3, including a connection line interconnecting the pressure chambers.

6. An apparatus according to claim 1, including a connection line between one chamber and an external storage tank.

7. An apparatus according to claim 1, including a connection line between one chamber and the atmosphere under favorable environmental conditions.

* * * * *